United States Patent [19]

Rhodes et al.

[11] 4,177,134

[45] Dec. 4, 1979

[54] SEPARATION TECHNIQUE IN A COAL DEASHING PROCESS

[75] Inventors: Donald E. Rhodes; Roger A. Baldwin; Robert E. Davis, all of Oklahoma City, Okla.

[73] Assignee: Kerr-McGee Corporation, Oklahoma City, Okla.

[21] Appl. No.: 887,867

[22] Filed: Mar. 20, 1978

[51] Int. Cl.[2] ..... C10G 21/16

[52] U.S. Cl. ..... 208/177

[58] Field of Search ..... 208/177, 8 LE

[56] References Cited

U.S. PATENT DOCUMENTS

| | | | |
|---|---|---|---|
| 4,028,221 | 6/1977 | Sze et al. | 208/8 LE |
| 4,040,957 | 8/1977 | Sze et al. | 208/8 LE |
| 4,070,268 | 1/1978 | Davis et al. | 208/8 LE |
| 4,079,004 | 3/1978 | Tan et al. | 208/8 LE |
| 4,094,766 | 6/1978 | Gorin | 208/8 LE |
| 4,127,475 | 11/1978 | Farcasiu et al. | 208/8 LE |

*Primary Examiner*—George Crasanakis

*Attorney, Agent, or Firm*—William G. Addison

[57] ABSTRACT

An improved coal deashing process wherein a feed mixture comprising soluble coal products, insoluble coal products, and deashing solvent at a first temperature level is separated in a first separation zone into a first light fraction and a first heavy fraction comprising the insoluble coal products and some of the deashing solvent through admixing predetermined quantities of an additive with the feed mixture prior to separation to provide an improved yield of recoverable soluble coal products. Alternatively, the additive is admixed with the first light fraction prior to subsequent separations to provide an improved yield of recoverable soluble coal products.

12 Claims, 4 Drawing Figures

SEPARATION TECHNIQUE IN A COAL DEASHING PROCESS

BACKGROUND OF THE INVENTION

1. Field of the Invention

The present invention relates generally to coal deashing processes and, more particularly, but not by way of limitation, to improved separation techniques in coal deashing processes.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal products are separated into multiple fractions. Other processes for separating the soluble coal products from the insoluble coal products utilizing one or more solvents are disclosed in U.S. Pat. Nos. 3,607,718 and 3,642,608, both issued to Roach et al., and assigned to the same assignee as the present invention.

SUMMARY OF THE INVENTION

The surprising discovery now has been made that the addition of a predetermined amount of an additive, to be hereinafter described, to a feed mixture comprising soluble coal products, insoluble coal products and deashing solvent results in an improved separation of the soluble coal products from the insoluble coal products.

In one embodiment, the present invention contemplates admixing predetermined quantities of the feed mixture with an additive prior to separation of the feed in a first separation zone.

In another embodiment, the present invention contemplates introducing an additive directly into the upper portion of the first separation zone.

In yet another embodiment, the present invention contemplates admixing predetermined quantities of an additive with the first light fraction withdrawn from the first separation zone before introduction into a subsequent separation zone.

In still yet another embodiment, the present invention contemplates introducing an additive directly into the upper portion of the subsequent separation zone.

DESCRIPTION OF THE PREFERRED EMBODIMENTS

Figure 1:
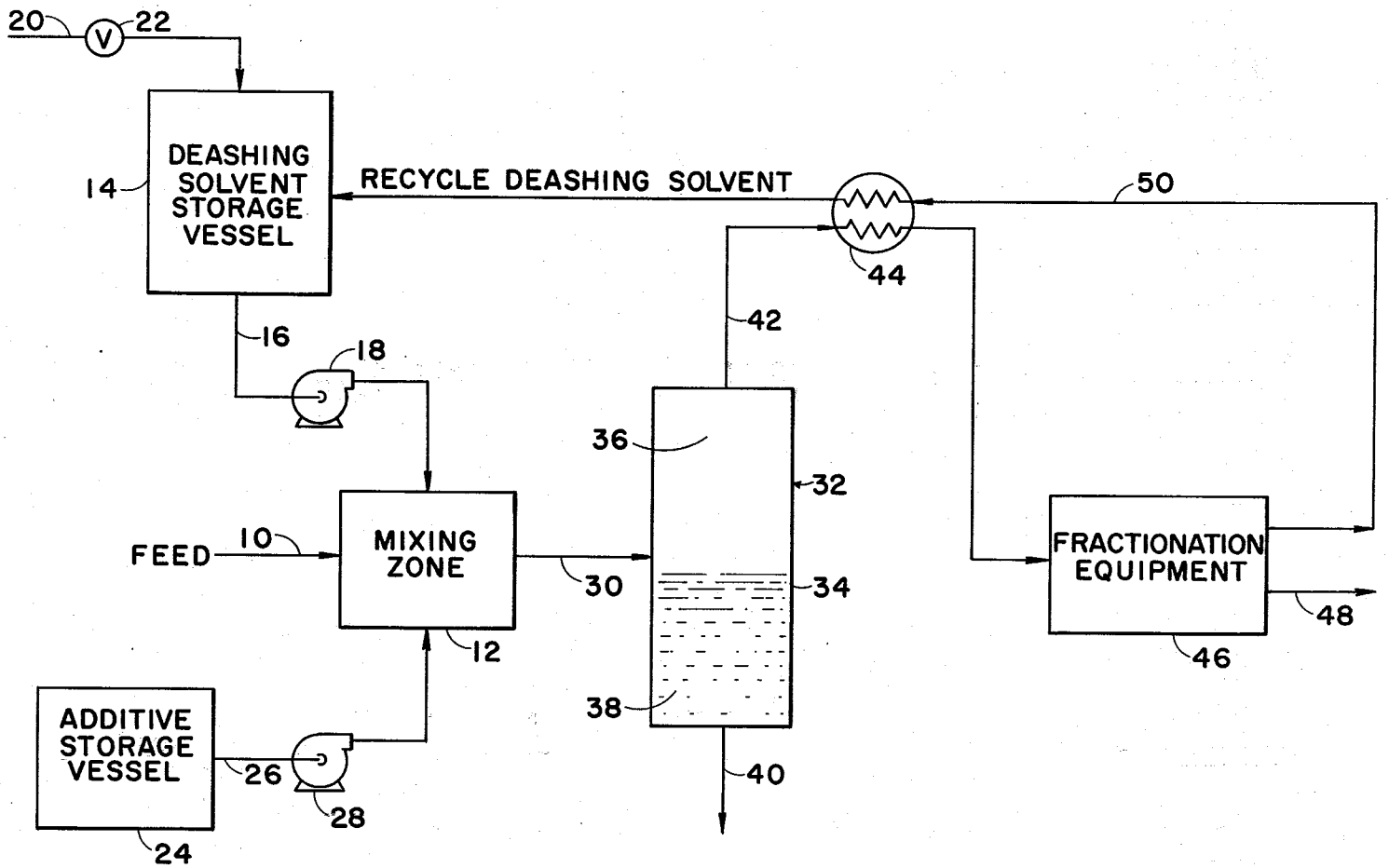
FIG. 1 diagrammatically and schematically illustrates a coal deashing system arranged in accordance with the present invention.

Turning now to FIG. 1, a feed comprising soluble coal products and insoluble coal products is introduced into a mixing zone 12 through a conduit 10 from a source not shown.

The feed can be produced by any process which effects a solubilization of coal to provide a product or fraction thereof consisting of soluble coal products and insoluble coal products.

A deashing solvent is contained in a deashing solvent storage vessel 14. The deashing solvent is withdrawn from the vessel 14 through a conduit 16 and pumped by a pump 13 interposed therein into the mixing zone 12. Make-up deashing solvent is added to the deashing surge vessel 14 via a conduit 20 and the flow of the make-up deashing solvent is controlled by a valve 22 interposed in the conduit 20. Sufficient deashing solvent is introduced into the mixing zone 12 to provide a ratio by weight of solvent to feed in the feed mixture of from about 1:1 to about 10:1. It is to be understood that larger amounts of deashing solvent can be used, however such use is uneconomical.

An additive is contained in a storage vessel 24. The additive is withdrawn from vessel 24 through a conduit 26 in a predetermined quantity and pumped by a pump 28 interposed in conduit 26 into the mixing zone 12. The quantity of additive introduced is in a range of from about 0.1 percent to about 20 percent by weight of the feed mixture. Preferably, the additive is present in a range of from about 0.5 percent to about 15 percent by weight of the feed mixture.

In the mixing zone 12, the feed introduced through conduit 10 is contacted by and mixed with the deashing solvent introduced through conduit 16 to form a feed mixture. The additive introduced through conduit 26 into the mixing zone 12 contacts and mixes with the feed and deashing solvent and the resulting mixture is discharged from the mixing zone 12 into and through the conduit 30, the mixture discharged from the mixing zone 12 comprising and being referred to herein as the "new feed mixture".

The mixing zone 12 can comprise any means capable of admixing the streams entering into contact therein. The admixing can be effected within mixing zone 12 by simultaneously contacting the feed, deashing solvent and additive. Alternatively, the feed can be contacted by the deashing solvent or the deashing solvent can be contacted by the additive and this mixture is contacted by the feed. In yet another alternative, the feed can be contacted by the deashing solvent and then this mixture is contacted by the additive, while still within the mixing zone 12, to provide the new feed mixture.

The discharged new feed mixture in conduit 30 enters a first separation zone 32 comprising a first phase separating vessel 34. The temperature level in the first separation zone 32 (the first temperature level) is maintained lower than about 750 degrees F. and, more particularly, the first temperature level is from about 400 degrees F. to about 700 degrees F. and the pressure level is maintained in the range of from about 500 psig to about 1500 psig to effect a separation of the new feed mixture.

In the vessel 34, the new feed mixture separates into a first light fraction in a upper portion 36 of the vessel 34 and a first heavy fraction in a lower portion 38 of the vessel 34. The first heavy fraction is allowed to settle within the lower portion 38 while the fist light fraction rises to the upper portion 36.

The first heavy fraction, comprising substantially insoluble coal products, some soluble coal products, some deashing solvent and at least a portion of the additive is withdrawn from the first phase separating vessel 34 by a conduit 40 for subsequent recovery of additional hydrocarbon values by means not shown.

The first light fraction which rises to an upper portion 36 of the first phase separating vessel 34 is a solvent-rich fraction comprising substantially the soluble coal products and the deashing solvent. The first light fraction is withdrawn from the first phase separating vessel 34 through a conduit 42 and passed through a heat exchanger 44 interposed in the conduit 42, to fractionating equipment designated in the drawing by the general reference numeral 46. In one embodiment, the fractionating equipment 46 is designed to separate the first light fraction into one or more coal liquefaction fractions (soluble coal products) which are discharged through a conduit 48 (the conduit 48 being two or more separate conduits in those systems where the soluble coal products are separated into more than one fraction with each individual fraction passing through one of the several conduits represented by the conduit 48 diagrammatically shown in the drawing).

The deashing solvent passed into the fractionating equipment 46 via the conduit 42 is separated from the soluble coal products. The separated deashing solvent is passed from the fractionating equipment 46 through a conduit 50, and through the heat exchanger 44 before being returned to the deashing solvent storage vessel 14.

The soluble coal products thus recovered from the first light fraction within the fractionating equipment 46 are recovered in a yield improved over that which would otherwise be generally possible.

Normally, the separation zone is operated under temperature and pressure conditions such that the deashing solvent density is maintained at a level sufficiently low so as to cause the rejection or separation of a small amount of the heavy liquefied coal constituents into a heavy fraction. While the mechanism is not fully understood, it is believed that the coal liquefaction products thus rejected from the solution tend to coat the micron-sized particles of insoluble material in the solution. This coating causes the surface of the particles to be tacky, and enlarges the particles somewhat so that they are much easier to agglomerate than would otherwise be true. The amount of coal liquefaction products separated as a heavy fraction need only be sufficient to coat the particles and with the attendant dissolving solvent, aid in the agglomeration and fluxing thereof, and usually is from about 1 to about 5 times the weight of the insoluble material.

Further, it has been found that some coal liquefaction products appear to have lesser amounts of heavy liquefied coal constituents than other coal liquefaction products and as a consequence, to obtain coal deashing more lower molecular weight liquefied coal must be rejected to achieve the desired deashing of the liquefaction product.

Thus, the improved yield of soluble coal products contemplated by this invention results from the fact that less lighter weight soluble coal products are required to cause the rejection or separation of the insoluble coal products due to the presence of the heavier weight additive which is believed to aid in agglomerating the insoluble material and which would normally not be present in such quantities in the coal liquefaction products.

Figure 2:
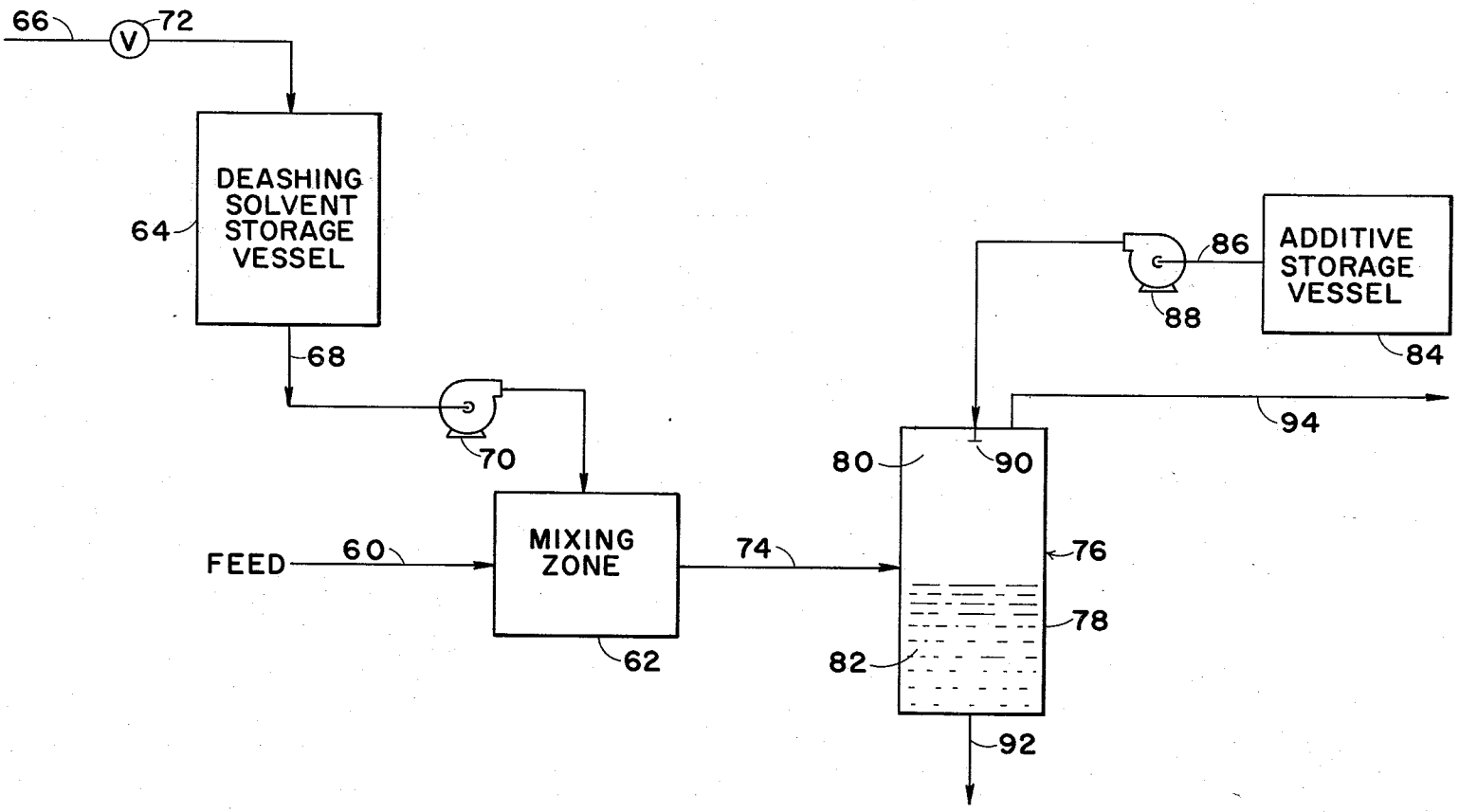
FIG. 2 diagrammatically and schematically illustrates another arrangement of a coal deashing system arranged in accordance with the present invention.

Turning now to FIG. 2, another embodiment of the present invention is illustrated.

In this embodiment of the invention, a feed comprising soluble coal products and insoluble coal products is introduced into a mixing zone 62 through a conduit 60.

A deashing solvent is contained in a deashing solvent storage vessel 64 and is withdrawn from vessel 64 through a conduit 68 and pumped by a pump 70 interposed therein into the mixing zone 62. Make-up deashing solvent is added to the deashing solvent storage vessel 64 via a conduit 66 and the flow of the make-up deashing solvent is controlled by a valve 72 interposed in the conduit 66.

In the mixing zone 62, the feed from conduit 60 is contacted by the deashing solvent and the resulting mixture is discharged from the mixing zone 62 into and through a conduit 74. The mixture discharged from the mixing zone 62 comprising and being referred to as the "new feed mixture".

The mixture flowing in conduit 74 enters a first separation zone 76 comprising a first phase separation vessel 78. In the vessel 78, the feed mixture is caused to separate by controlling conditions therein to form a first light fraction comprising soluble coal products, deashing solvent and some insoluble coal products in an upper portion 80 of the vessel 78 and a first heavy fraction in a lower portion 82 of the vessel 78. An additive contained in a storage vessel 84 is withdrawn via a conduit 86 and pumped by a pump 88 interposed therein through a distributor 90 to enter into the upper portion 80 of the first phase separating vessel 78. The additive is distributed by the distributor 90 contained within the upper portion 80 of vessel 78 and is allowed to pass or settle therethrough to scrub additional insoluble coal material from the first light fraction. The amount of additive introduced is in a range of from about 0.1 percent to about 20 percent by weight of the feed mixture. Preferably, the additive is present in a range of from about 0.5 percent to about 15 percent by weight of the feed mixture.

In this embodiment, the temperature level in the first separation zone 76 is maintained lower than about 750 degrees F. and the pressure level is maintained in a range of from about 600 psig to about 1500 psig to effect the separation therein. Preferably the temperature level is maintained in the range of from about 400 degrees F. to about 700 degrees F.

The first heavy fraction, comprising insoluble coal products, some soluble coal products, some deashing solvent and additive is withdrawn from the first phase separating vessel 78 by a conduit 92 for passage to subsequent recovery apparatus beyond the scope of the present invention. If desired, the solvent can be recovered from the first heavy fraction and recycled to aid in providing the new feed mixture A.

The first light fraction is withdrawn from the first phase separating vessel 78 by a conduit 94 and recovered in a yield improved over that which is obtained without the addition of the additive.

Figure 3:
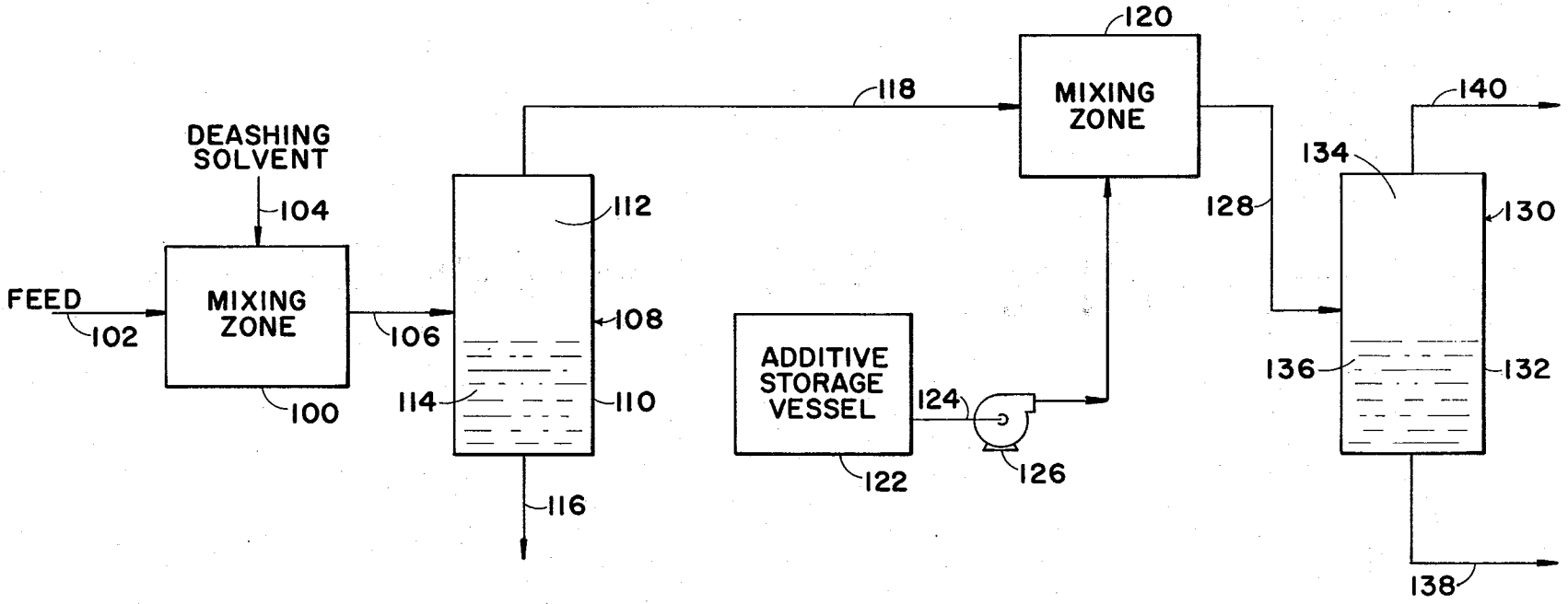
FIG. 3 diagrammatically and schematically illustrates another arrangement of a coal deashing system arranged in accordance with the present invention.

Turning now to FIG. 3, in yet another embodiment of the invention, a feed is introduced into a mixing zone 100 through a conduit 102 to contact and mix with a deashing solvent entering the mixing zone 100 through a conduit 104 and is discharged through a conduit 106 into a first separation zone 108. The mixture discharged from the mixing zone 100 comprises and is the same as the previously described feed mixture.

The first separation zone 108 comprises a first phase separating vessel 110. In this embodiment, the temperature level in the first separation zone 108 is maintained lower than about 750 degrees F. and the pressure level in the first separation zone 122 is maintained in a range of from about 600 psig to about 1500 psig to effect a separation of the feed mixture into a first light fraction in an upper portion 112 of the vessel 110 and a first heavy fraction in a lower portion 114 of the vessel 110.

The first heavy fraction, comprising the insoluble coal products, some deashing solvent and some soluble coal products is withdrawn from the first phase separating vessel 110 by a conduit 116 for subsequent processing to recover additional soluble coal products and deashing solvent.

The first light fraction comprising the soluble coal products, deashing solvent and some insoluble coal products is withdrawn from the first phase separating vessel 110 by a conduit 118 to enter a mixing zone 120.

An additive contained in a storage vessel 122 is withdrawn via a conduit 124 and pumped by a pump 126 interposed therein into the mixing zone 120. The additive is admixed with predetermined quantities of the feed mixture in an amount sufficient such that it is present in a range of from about 0.1 percent to about 20 percent by weight of the feed mixture. Preferably, the additive is present in a range of from about 0.5 percent to about 15 percent by weight of the feed mixture.

In mixing zone 120, the first light fraction is admixed with the entering additive to form a mixture and the mixture is discharged via a conduit 128 to enter a second separation zone 130 comprising a second phase separating vessel 132. In the second phase separating vessel 132 the mixture is caused to separate, by controlling conditions therein, into a second light fraction comprising the soluble coal products and deashing solvent in an upper portion 134 of vessel 132 and a second heavy fraction comprising the insoluble coal products, the additive, some soluble coal products and some deashing solvent in a lower portion 136 of vessel 132.

The pressure level in the second separation zone 130 is slightly less than the pressure level in the first separation zone 108 and more particularly the pressure level is maintained in a range of from about 300 psig to about 1490 psig. The temperature level in the second separation zone 130 is maintained slightly higher than the temperature level in the first separation zone 108. More particularly, the temperature level is in a range of from about 500 degrees F. to about 900 degrees F.

The second heavy fraction is withdrawn from the second phase separating vessel 132 through a conduit 138 for passage to additional recovery means to separate the deashing solvent and soluble coal products from the insoluble coal products (not shown).

The second light fraction is withdrawn from the second phase separating vessel 132 through a conduit 140 and recovered. The soluble coal products contained in the second light phase are recovered in a yield improved over that which is obtained without the addition of the additive. The withdrawn second light fraction also can be subjected to additional fractionation.

Figure 4:
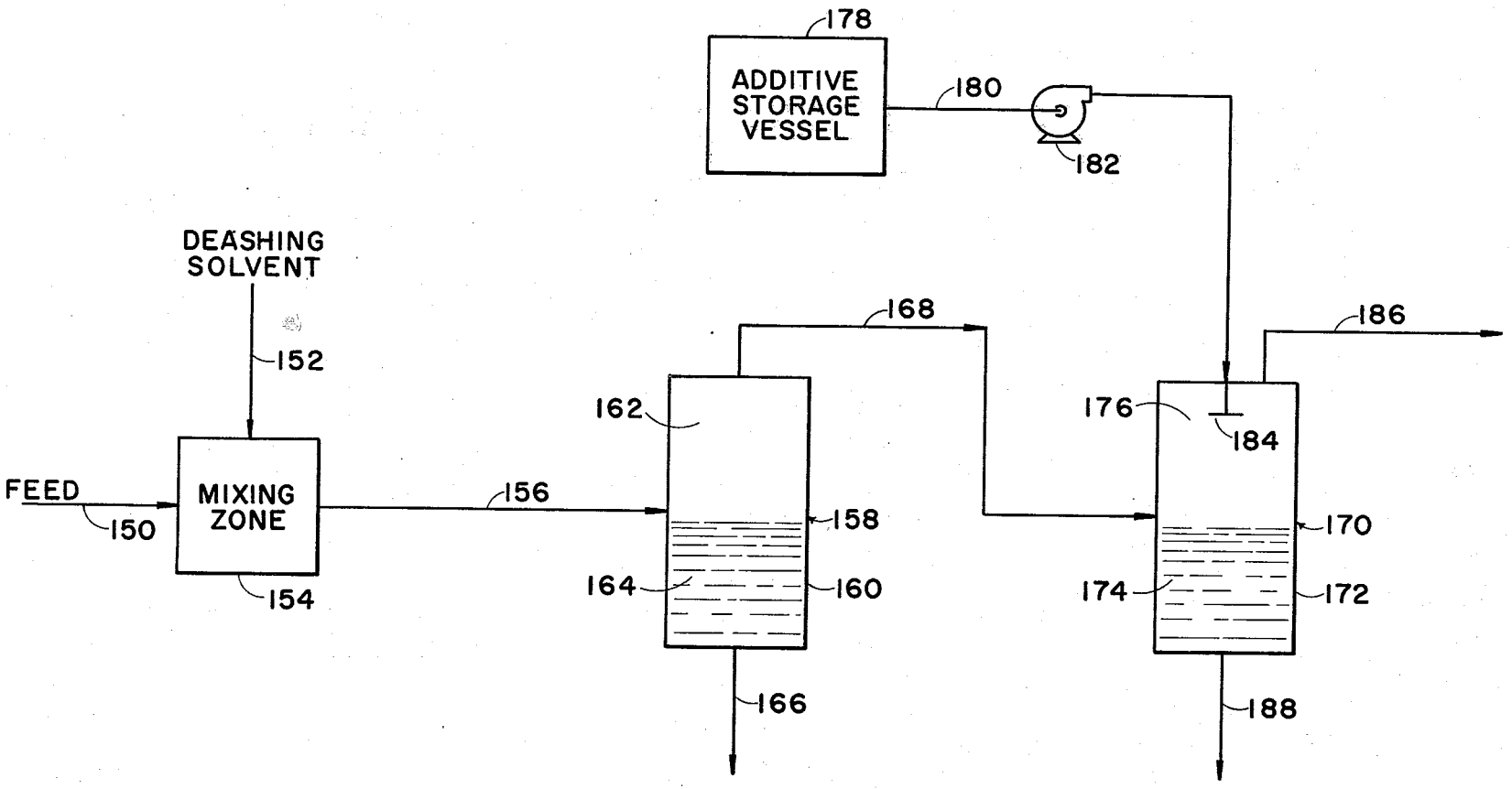
FIG. 4 diagrammatically and schematically illustrates yet another arrangement of a coal deashing system arranged in accordance with the present invention.

Turning now to FIG. 4, in still yet another embodiment of the invention, a feed entering via a conduit 150 is contacted with a deashing solvent entering via a conduit 152 in a mixing zone 154 and is discharged through a conduit 156 into a first separation zone 158. The mixture introduced into the first separation zone 158 comprises and is the same as the previously described feed mixture.

The first separation zone 158 comprises a first phase separating vessel 160. In this embodiment, the temperature level in the first separation zone 160 is maintained lower than about 750 degrees F. and preferably in the range of from about 400 degrees F. to about 700 degrees F. and the pressure level is maintained in a range of from about 600 psig to about 1500 psig to effect a separation therein. In the vessel 160, the feed mixture separates into a first light fraction in an upper portion 162 of vessel 160 and a first heavy fraction in a lower portion 164 of vessel 160.

The first heavy fraction comprising most of the insoluble coal products, some dissolving solvent and some soluble coal products is withdrawn from the first phase separating vessel 160 by a conduit 166 for subsequent treatment beyond the scope of the present invention.

The first light fraction comprising the soluble coal products, dissolving solvent and some insoluble coal products is withdrawn from the first phase separating vessel 160 by a conduit 168 and is introduced into a second separation zone 170 comprising a second phase separating vessel 172.

The pressure level in the second separation zone 170 is maintained slightly lower than the pressure level in the first separation zone 168. More particularly, the pressure level is in a range of from about 300 psig to about 1490 psig. The temperature level in the second separation zone 170 is maintained slightly higher than the temperature level in the first separation zone 158. Preferably, the temperature level is maintained in a range of from about 500 degrees F. to about 900 degrees F.

In vessel 172, the first light fraction separates into a fluid-like second heavy fraction in a lower portion 174 and a second light fraction in an upper portion 176 of vessel 172 by controlling conditions therein.

An additive contained in a storage vessel 178 is withdrawn via a conduit 180 and pumped by a pump 182 interposed therein to enter a distributor 184 in the upper portion 176 of second phase separating vessel 172. The additive is dispersed within the upper portion 176 of vessel 172 by the distributor 184 and permitted to pass or settle therethrough to scrub insoluble coal products from the second light fraction. The additive is introduced in an amount sufficient to be present in a range of from about 0.1 percent to about 20 percent by weight of the feed mixture. Preferably, the additive is present in a range of from about 0.5 percent to about 15 percent by weight of the feed mixture.

The second light fraction, comprising soluble coal products now substantially free of insoluble coal products and deashing solvent is withdrawn from the second phase separating vessel 172 through a conduit 186 for recovery or additional processing. The soluble coal products are recovered in a yield improved over that which is obtained without the addition of the additive.

The second heavy fraction is withdrawn from the second phase separating vessel 172 through a conduit 188 for recovery.

The term "additive" as used herein means at least one member selected from the group consisting of:

1. Asphaltenes derived from petroleum, coal, shale or tar sand, said asphaltenes being insoluble in aromatic hydrocarbons, such as benzene or toluene;

2. Tannins;

3. "Chlorophyll a" having the molecular formula $C_{55}H_{72}MgN_4O_5$;

4. "Chlorophyll b" having the molecular formula $C_{55}H_{70}MgN_4O_6$;

5. Materials of chemical composition corresponding to the empirical chemical formula $C_{61}H_{46}N_2O_4$ and having molecular weights of about 870.

6. Materials of chemical composition corresponding to the empirical chemical formula $C_{61}H_{46}N_2O_4$ but having molecular weights greater than about 870, said material being insoluble in aromatic hydrocarbons such as benzene or toluene;

7. Asphaltols (as defined by Farcasiu, M., Mitchell, T. O., Whitehurst, D. D., in "Asphaltols-keys to coal liquefaction," Chemtech, November 1977 pp 680–686; generally, molecules having three or more oxygen atoms, the remainder being carbon, hydrogen and nitrogen.) from coal dissolution processes, said asphaltols being insoluble in aromatic hydrocarbons such as benzene and toluene; and 8. Asphaltols from coal pyrolysis processes, said asphaltols being insoluble in aromatic hydrocarbons such as benzene and toluene.

The term "insoluble coal products" as used herein refers to the undissolved coal, mineral matter, other solid inorganic particulate matter and other such matter which is insoluble in the deashing solvent under the conditions of this invention.

In the process generally described above, the "deashing solvent" means the type solvents sometimes described as a "light organic solvent" in U.S. Pat. Nos. 3,607,716, 3,607,717, 3,607,718 and 3,642,608 the disclosures of which are incorporated herein by reference and includes, for example, pyridine, benzene, toluene and xylenes.

More specifically, the "deashing solvent" consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

For the purpose of illustrating the present invention, and not by way of limitation, feed mixtures are prepared by mixing coal liquefaction products with a deashing solvent (comprising benzene) in a ratio of about one part by weight of coal liquefaction products to about 5 parts by weight of benzene at a pressure level in the range of from about 600 psig to about 1500 psig and at a temperature level in the range of from about 400 degrees F. to about 700 degrees F. The coal liquefaction products were analyzed and found to have the analyses set forth in Table I below.

TABLE I

| SESC* Analysis Fractions, wt. % | |
|---|---|
| 1 | 0.5 |
| 2 | 5.9 |
| 3 | 17.3 |
| 4 | 9.1 |
| 5 | 8.7 |
| 6 | 3.6 |
| 7 | 5.2 |
| 8 | 7.2 |
| 9 | 4.0 |
| 10 | 38.5 |
| % ash content fraction 10 | 66.0 |

*Sequential Elution Solvent Chromatography described by D. D. Whitehurst et al in "The Nature And Origin Of Asphaltenes In Processed Coals" Government doc. no. PB 257569, published February 1976.

The prepared feed mixtures then are utilized in various test runs to demonstrate the effectiveness of the present invention. In each of the test runs, the feed mixture is introduced into the apparatus at a rate of about 200 lbs/hr and the additive comprising asphaltols when present, is introduced at a rate of about 10 lbs/hr (5% by weight of the feed mixture).

EXAMPLE I

Two runs are set forth to illustrate the present invention. Specifically, one run is made without the addition of an additive. In the second run, an additive is introduced into the mixing zone 12 to contact the feed mixture therein as illustrated in FIG. 1.

In each instance, the temperature level in the first phase separating vessel 34 is about 550 degrees F. and the pressure level is about 800 psig. The first light fraction is continuously withdrawn through a conduit 42 and treated to recover the soluble coal products therefrom. It is determined that soluble coal products obtained from the first run are produced at a rate of about 76 lbs/hr and contain from about 0.05 percent to about 0.2 percent by weight of ash. By way of contrast, the soluble coal products from the run in which the additive is present are recovered in greater quantity with comparable ash content.

EXAMPLE II

Two runs are conducted: one run is made without the additive; and in the second run, the additive is introduced into the upper portion of first phase separating vessel 78 as illustrated in FIG. 2.

In each instance, the temperature level in the first phase separating vessel 78 is about 530 degrees F. and the pressure level is about 800 psig. The first light fraction continuously withdrawn through conduit 94 and treated to recover the soluble coal products therefrom. It is determined that soluble coal products obtained from the first run, without the additive, are produced at a rate of about 80 lbs/hr and contain from about 0.05 percent to about 0.2 percent by weight of ash. By way of contrast the soluble coal products from the run in which the additive is present are recovered in greater quantity with comparable ash content.

EXAMPLE III

Two runs are conducted: one run is made without the additive; and in the second run, the additive is introduced into the mixing zone 120 as illustrated in FIG. 3.

In each instance, the temperature level in the first phase separating vessel 110 is about 530 degrees F. and the pressure is about 800 psig and the temperature level in the second phase separating vessel 132 is about 550 degrees F. and the pressure level is about 780 psig. The second light fraction is continuously withdrawn from the second separating vessel 132 through conduit 140 and treated to recover the soluble coal products therefrom. It is determined that soluble coal products obtained from the first run, without the additive, are produced at a rate of about 80 lbs/hr and contain from about 0.05 percent to about 0.2 percent by weight of ash. By way of contrast, the soluble coal products from the run in which the additive is present are recovered in greater quantity with comparable ash content.

EXAMPLE IV

Two runs are conducted: one run is made without the additive; and in the second run, the additive is introduced into the upper portion of the second phase separating vessel 172 as illustrated in FIG. 4.

In each instance, the temperature level in the first phase separating vessel 160 is about 530 degrees F. and the pressure level is about 800 psig and the temperature level in the second phase separating vessel 172 is about 550 degrees F. and the pressure level is about 780 psig. The second light fraction is continuously withdrawn from the second separating vessel 172 through conduit 186 and treated to recover the soluble coal products therefrom. It is determined that soluble coal products obtained from the first run, without the additive, are produced at a rate of about 80 lbs/hr and contain from about 0.05 percent to about 0.2 percent by weight of ash. By way of contrast, the soluble coal products from the run in which the additive is present are recovered in greater quantity with comparable ash content.

While the subject invention has been described employing only one to two separation zones, it is to be understood that the process of this invention would be equally applicable to a coal liquefaction product which has been subjected to a multiplicity of prior separations before addition of the additive and also multiple additions of the additive to the separations described herein.

Therefore, while this invention has been described with respect to what at present are considered to be the preferred embodiments thereof, it is to be understood that changes and or modifications in the steps of the process or the apparatus can be made without departing from the spirit or scope of the present invention, as defined in the following claims.

What is claimed is:

1. A process comprising:

providing a feed mixture comprising a deashing solvent, insoluble coal products and soluble coal products;

providing an additive, said additive consisting essentially of at least one substance selected from the group consisting of:

(i) asphaltenes derived either from petroleum, coal shale or tar sand, said asphaltenes being insoluble in aromatic hydrocarbons;

(ii) tannins;

(iii) "chlorophyll a" having the molecular formula $C_{55}H_{72}MgN_4O_5$;

(iv) "chlorophyll b" having the molecular formula $C_{55}H_{70}MgN_4O_6$;

(v) materials of chemical composition corresponding to the emphirical chemical formula $C_{61}H_{46}N_2O_4$, having molecular weights of about 870 or greater; and (vi) asphaltols from coal dissolution processes or coal pyrolysis processes, said asphaltols being insoluble in aromatic hydrocarbons;

admixing predetermined quantities of said additive with said feed mixture to provide a new feed mixture;

introducing said new feed mixture into a first separation zone;

maintaining said first separation zone at a first temperature level lower than about 750 degrees F. and a pressure level in a range of from about 600 psig to about 1500 psig to separate said new feed mixture in said first separation zone into a first heavy fraction comprising the insoluble coal products, some deashing solvent, some soluble coal products and at least a portion of the additive and a light fraction comprising the deashing solvent and soluble coal products;

withdrawing said first heavy fraction from said first separation zone; and withdrawing said first light fraction from said first separation zone.

2. The process of claim 1 wherein admixing said additive with said feed mixture is further defined as:

admixing said additive in an amount sufficient to be present in a range of from about 0.1 percent to about 20 percent by weight of said feed mixture.

3. The process of claim 1 wherein admixing said additive with said feed mixture is defined further as:

admixing said additive in an amount sufficient to be present in a range of from about 0.5 percent to about 15 percent by weight of said feed mixture.

4. A process comprising:

providing a feed mixture comprising a deashing solvent, insoluble coal products and soluble coal products;

introducing said feed mixture into a first separating zone;

maintaining said first separation zone at a first temperature level lower than about 750 degrees F. and a pressure level in a range of from about 600 psig to about 1500 psig to separate the feed mixture into a first heavy fraction comprising insoluble coal products, some soluble coal products and some deashing solvent in a lower portion of the first separation zone and a first light fraction comprising soluble coal products, deashing solvent and some insoluble coal products in an upper portion of the first separation zone;

introducing an additive into said light fraction located within the upper portion of said first separation zone to pass therethrough to scrub said insoluble coal products therefrom, said additive consisting essentially of at least one substance selected from the group consisting of:

(i) asphaltenes derived either from petroleum, coal, shale or tar sand, said asphaltenes being insoluble in aromatic hydrocarbons;

(ii) tannins;

(iii) "chlorophyll a" having the molecular formula $C_{55}H_{72}MgN_4O_5$;

(iv) "chlorophyll b" having the molecular formula $C_{55}H_{70}MgN_4O_6$;

(v) materials of chemical composition corresponding to the emphirical chemical formula $C_{61}H_{46}N_2O_4$, having molecular weights of about 870 or greater; and (vi) asphaltols from coal dissolution processes or coal pyrolysis processes, said asphaltols being insoluble in aromatic hydrocarbons;

withdrawing said first light fraction, substantially free of the insoluble coal products, from said first separation zone; and withdrawing said first heavy fraction comprising insoluble coal products, some soluble coal products, some deashing solvent and at least a portion of the additive from said first separation zone.

5. The process of claim 4 wherein introducing said additive is further defined as:

introducing said additive in an amount sufficient to be present in a range of from about 0.1 percent to about 20 percent by weight of said feed mixture.

6. The process of claim 4 wherein introducing the additive is defined further as:

introducing said additive in an amount sufficient to be present in a range of from about 0.5 percent to about 15 percent by weight of said feed mixture.

7. A process comprising:

providing a feed mixture comprising a deashing solvent, insoluble coal products and soluble coal products;

introducing said feed mixture into a first separation zone;

maintaining said first separation zone at a first temperature level lower than about 750 degrees F. and a pressure level in a range of from about 600 psig to about 1500 psig to separate said feed mixture into a first heavy fraction comprising insoluble coal products, some deashing solvent and some soluble coal products and a first light fraction comprising the soluble coal products, deashing solvent and some insoluble coal products;

withdrawing said first heavy fraction from said first separation zone;

withdrawing said first light fraction from said first separation zone;

providing an additive, said additive consisting essentially of at least one substance selected from the group consisting of:

(i) asphaltenes derived either from petroleum, coal, shale or tar sand, said asphaltenes being insoluble in aromatic hydrocarbons;

(ii) tannins;

(iii) "chlorophyll a" having the molecular formula $C_{55}H_{72}MgN_4O_5$;

(iv) "chlorophyll b" having the molecular formula $C_{55}H_{70}MgN_4O_6$;

(v) materials of chemical composition corresponding to the emphirical chemical formula $C_{61}H_{46}N_2O_4$, having molecular weights of about 870 or greater; and (vi) asphaltols from coal dissolution processes or coal pyrolysis processes, said asphaltols being insoluble in aromatic hydrocarbons;

admixing said withdrawn first light fraction with predetermined quantities of said additive to provide a mixture;

introducing said mixture into a second separation zone;

maintaining said second separation zone at a temperature level higher than the temperature level in the first separation zone and a pressure level in a range of from about 300 psig to about 1490 psig to separate said mixture into a second heavy fraction comprising the remaining insoluble coal products, at least a portion of the additive, some deashing solvent and some soluble coal products and a second light fraction comprising the soluble coal products and the deashing solvent;

withdrawing said second heavy fraction from said second separation zone; and withdrawing said second light fraction from said second separation zone.

8. The process of claim 7 wherein admixing predetermined quantities of said additive is further defined as:

admixing said additive with said withdrawn first light fraction in an amount sufficient to be present in a range of from about 0.1 percent to about 20 percent by weight of said feed mixture.

9. The process of claim 7 wherein admixing predetermined quantities of said additive is defined further as:

admixing said additive with the withdrawn first light fraction in an amount sufficient to be present in a range of from about 0.5 percent to about 15 percent by weight of said feed mixture.

10. A process comprising:

providing a feed mixture comprising a deashing solvent, insoluble coal products;

introducing said feed mixture into a first separation zone;

maintaining said first separation zone at a first temperature level lower than about 750 degrees F. and a pressure level in a range of from about 600 psig to about 1500 psig to separate said feed mixture into a first heavy fraction comprising insoluble coal products, some deashing solvent and some soluble coal products and a first light fraction comprising soluble coal products, deashing solvent and some insoluble coal products;

withdrawing said first heavy fraction from said first separation zone;

withdrawing said first light fraction from said first separation zone;

introducing said withdrawn first light fraction into a second separation zone;

maintaining said second separation zone at a temperature level higher than the temperature level in the first separation zone and a pressure level in a range of from about 300 psig to about 1490 psig to separate the first light fraction into a second heavy fraction comprising the remaining insoluble coal products in a lower portion of the second separation zone and a second light fraction comprising soluble coal products, deashing solvent and some insoluble coal products;

introducing an additive into said second light fraction located within an upper portion of said second separation zone to pass therethrough to scrub insoluble coal products therefrom, said additive consisting essentially of at least one substance selected from the group consisting of:

(i) asphaltenes derived either from petroleum, coal, shale or tar sand, said asphaltenes being insoluble in aromatic hydrocarbons;

(ii) tannins;

(iii) "chlorophyll a" having the molecular formula $C_{55}H_{72}MgN_4O_5$;

(iv) "chlorophyll b" having the molecular formula $C_{55}H_{70}MgN_4O_6$;

(v) materials of chemical composition corresponding to the emphirical chemical formula $C_{61}H_{46}N_2O_4$, having molecular weights of about 870 or greater; and (vi) asphaltols from coal dissolution processes or coal pyrolysis processes, said asphaltols being insoluble in aromatic hydrocarbons;

withdrawing said second light fraction, substantially free of insoluble coal products, from the second separation zone; and withdrawing said second heavy fraction comprising the insoluble coal products and at least a portion of the additive.

11. The process of claim 10 wherein introducing an additive is further defined as:

introducing said additive in an amount sufficient to be present in a range of from about 0.1 percent to about 20 percent by weight of said feed mixture.

12. The process of claim 10 wherein introducing an additive is defined further as:

introducing said additive in an amount sufficient to be present in a range of from about 0.5 percent to about 15 percent by weight of said feed mixture.

* * * * *